US010801269B1

(12) United States Patent
Hankins et al.

(10) Patent No.: US 10,801,269 B1
(45) Date of Patent: Oct. 13, 2020

(54) THROUGH HOLE CARBIDE POWDER ONTO AN INNER SURFACE

(71) Applicant: Halliburton Energy Services, Inc., Houston, TX (US)

(72) Inventors: John Benjamin Hankins, Cleveland, TX (US); Kelley Leigh Plunkett, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/417,941

(22) Filed: May 21, 2019

(51) Int. Cl.
*E21B 10/42* (2006.01)
*E21B 10/62* (2006.01)

(52) U.S. Cl.
CPC ..... *E21B 10/62* (2013.01); *E21B 10/42* (2013.01)

(58) Field of Classification Search
CPC ..... E21B 10/42
See application file for complete search history.

(56) References Cited

U.S. PATENT DOCUMENTS 2,922,677 A * 1/1960 Kennedy ..... B23K 35/404 406/70
9,976,353 B2 5/2018 Hinz et al.
10,066,439 B2 9/2018 Hinz et al.

FOREIGN PATENT DOCUMENTS

WO 2018017127 1/2018

OTHER PUBLICATIONS

Technogenia Inc., Laser Cladding Applications Specialists Torch Applied Welding Products.

* cited by examiner

*Primary Examiner* — Kristyn A Hall
(74) *Attorney, Agent, or Firm* — Thomas Rooney; C. Tumey Law Group PLLC

(57) ABSTRACT

A method may comprise placing a plug in a chamber of a housing, sending a carbide powder through the one or more access ports such that the carbide power is directed around the plug and deposited on the inner surface, and removing the plug from the chamber. A rolling element assembly may comprise a housing having an outer surface and inner surface, carbide powder on the inner surface, and a rolling element attached in the chamber with a portion of the rolling element extends from the chamber, wherein the rolling element is in contact with the carbide powder deposited on the inner surface.

18 Claims, 7 Drawing Sheets

THROUGH HOLE CARBIDE POWDER ONTO AN INNER SURFACE

BACKGROUND

This disclosure relates generally to equipment utilized in drilling operations of subterranean wells and, in an example described below, more particularly a drill bit that may be mounted on the end of a drill string and rotated to break up a geologic formation. The drill bit may be rotated by turning the entire drill string, e.g., with a top drive at surface location, and/or the drill bit may be rotated using downhole equipment, such as a mud motor mounted within the drill string. When drilling, a drilling fluid is pumped through the drill string and discharged from the drill bit to remove cuttings and debris. The mud motor, if present in the drill string, may be selectively powered using the circulating drilling fluid.

One common type of drill bit is a "fixed cutter" bit, wherein cutters (also referred to as cutter elements, cutting elements, or inserts) are secured to a bit body at fixed positions. The bit body may be formed from a high strength material, such as tungsten carbide, steel, or a composite/matrix material, and the cutters may include a substrate or support stud made of a carbide (e.g., tungsten carbide), and an ultra-hard cutting surface layer or "table" made of a polycrystalline diamond material or a polycrystalline boron nitride material deposited onto or otherwise bonded to the substrate. Such cutters are commonly referred to as polycrystalline diamond compact ("PDC") cutters.

Some cutters are strategically positioned along leading edges of blades defined on the bit body such that the cutters engage the formation during drilling. In use, high forces are exerted on the cutters, and over time, a working surface or cutting edge of each cutter eventually wears down or fails. The cutting edge of a fixed cutter may be continuously exposed to the formation, while an exposed surface of a rolling element may be successively exposed to the formation and withdrawn from the formation as it rotates on the drill bit. In some instances, rolling elements may provide depth of cut control to the fixed cutters.

BRIEF DESCRIPTION OF THE DRAWINGS

These drawings illustrate certain aspects of some examples of the present disclosure and should not be used to limit or define the disclosure.

DETAILED DESCRIPTION

The present disclosure relates to earth-penetrating drill bits and, more particularly, to rolling-type depth of cut control (DOCC) elements that may be used in drill bits. A rolling DOCC element may include a generally cylindrical body strategically positioned and secured to the drill bit so that the rolling element is able to engage the formation during drilling. In response to drill bit rotation and depending on the selected orientation of the rolling element with respect to the body of the drill bit, the rolling element may roll against the underlying formation. The rolling element may be disposed in a housing. Carbide powder may be added to the inner surface of the housing to resist abrasion and wear on the housing from the rolling element during operations. Applying carbide powder to the inner surface may be a time-consuming manufacturing process. Damage to the inner surface of the housing may lead to loss of the rolling element during drilling operations. Applying the carbide powder to the housing from the outside may reduce manufacture time, prevent damage to the inner surface of the housing, and reduce the risk of losing the rolling element during drilling operations. Loss of rolling elements on the drill bit may lead to increased wear on the drill bit, reducing efficiency of the drill bit and increasing the wear and tear on a drilling system that supports the drill bit during drilling operations.

Figure 1:
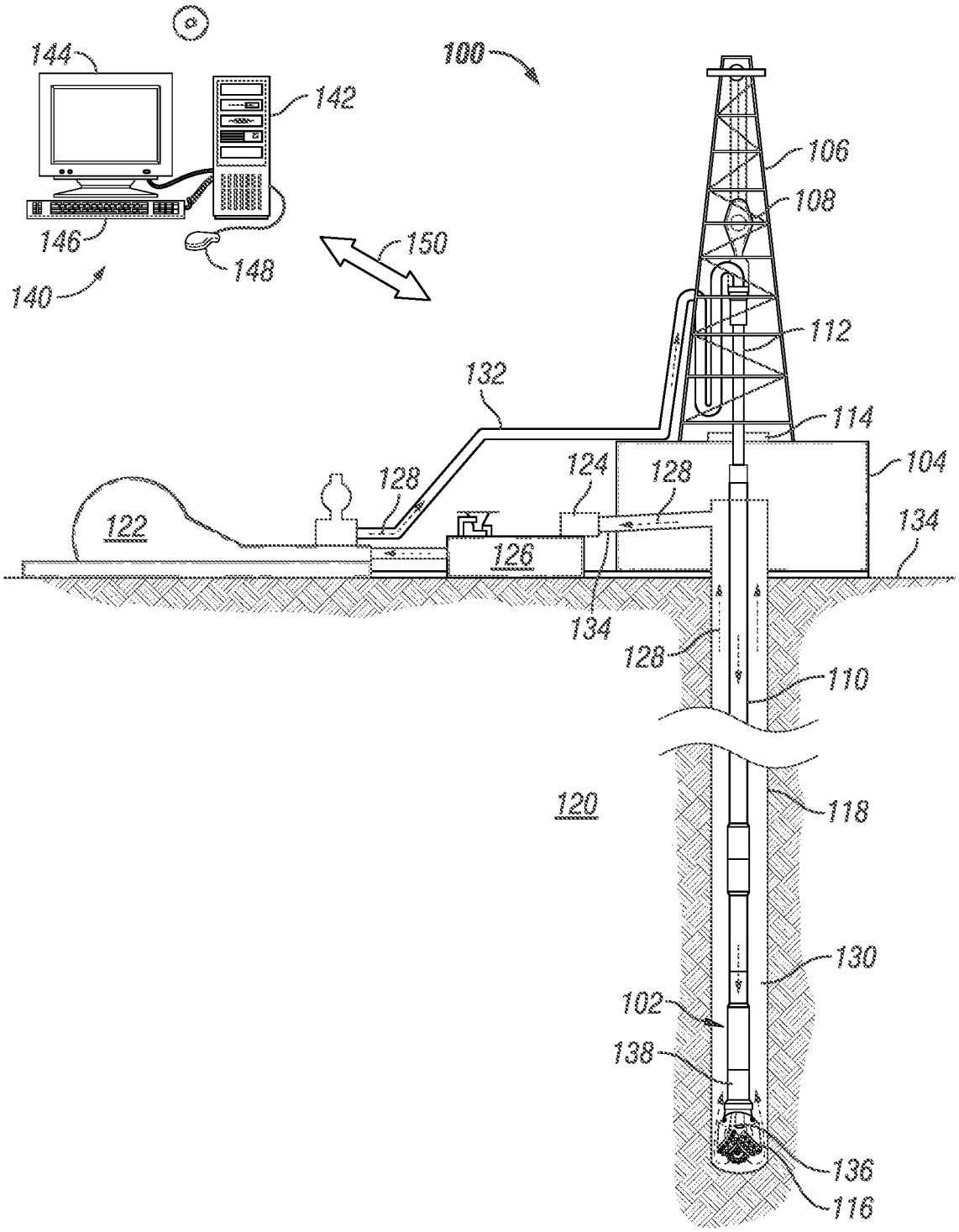
FIG. 1 illustrates an example of a drilling system

FIG. 1 illustrates a drilling system 100 that implements a drill bit 116 utilizing rolling elements (e.g., rolling elements 220 on FIG. 2) during drilling operations. It should be noted that while FIG. 1 generally depicts drilling system 100 in the form of a land-based system, those skilled in the art will readily recognize that the principles described herein are equally applicable to subsea drilling operations that employ floating or sea-based platforms and rigs, without departing from the scope of the disclosure.

Drilling system 100 may include a drilling platform 104 that supports a derrick 106 having a traveling block 108 for raising and lowering a drill string 110. A kelly 112 may support drill string 110 as drill string 110 may be lowered through a rotary table 114. Drilling system 100 may include a drill bit 116 attached to the distal end of drill string 110 and may be driven either by a downhole motor (not shown) and/or via rotation of drill string 110. Without limitation, drill bit 116 may include any suitable type of drill bit 116, including, but not limited to, roller cone bits, PDC bits, natural diamond bits, any hole openers, reamers, coring bits, and the like. As drill bit 116 rotates, drill bit 116 may create a borehole 118 that penetrates various formations 120.

Drilling system 100 may further include a mud pump 122, one or more solids control systems 124, and a retention pit 126. Mud pump 122 representatively may include any conduits, pipelines, trucks, tubulars, and/or pipes used to fluidically convey drilling fluid 128 downhole, any pumps, compressors, or motors (e.g., topside or downhole) used to drive the drilling fluid 128 into motion, any valves or related joints used to regulate the pressure or flow rate of drilling fluid 128, any sensors (e.g., pressure, temperature, flow rate, etc.), gauges, and/or combinations thereof, and the like.

Mud pump 122 may circulate drilling fluid 128 through a feed conduit 132 and to kelly 112, which may convey drilling fluid 128 downhole through the interior of drill string 110 and through one or more orifices (not shown) in drill bit 116. Drilling fluid 128 may then be circulated back to surface 134 via a borehole annulus 130 defined between drill string 110 and the walls of borehole 118. At surface 134, the recirculated or spent drilling fluid 128 may exit borehole annulus 130 and may be conveyed to one or more solids control system 124 via an interconnecting flow line 134. One or more solids control systems 124 may include, but are not limited to, one or more of a shaker (e.g., shale shaker), a centrifuge, a hydrocyclone, a separator (including magnetic and electrical separators), a desilter, a desander, a separator, a filter (e.g., diatomaceous earth filters), a heat exchanger, and/or any fluid reclamation equipment. The one or more solids control systems 124 may further include one or more sensors, gauges, pumps, compressors, and the like used to store, monitor, regulate, and/or recondition the drilling fluid 128.

After passing through the one or more solids control systems 124, drilling fluid 128 may be deposited into a retention pit 126 (e.g., a mud pit). While illustrated as being arranged at the outlet of borehole 118 via borehole annulus 130, those skilled in the art will readily appreciate that the one or more solids controls system 124 may be arranged at any other location in drilling system 100 to facilitate its proper function, without departing from the scope of the disclosure. While FIG. 1 shows only a single retention pit 126, there could be more than one retention pit 126, such as multiple retention pits 126 in series. Moreover, retention pit 126 may be representative of one or more fluid storage facilities and/or units where the drilling fluid additives may be stored, reconditioned, and/or regulated until added to drilling fluid 128.

In addition, measurement module 102 may further include communication module 138. Communication module 138 may be configured to transmit information to surface 134. While not shown, communication module 138 may also transmit information to other portions of the bottom hole assembly (e.g., rotary steerable system) or a data collection system further up the bottomhole assembly. For example, communication module 138 may transmit gyroscope measurements and/or additional sensor measurements from measurement module 102. In addition, where processing occurs at least partially downhole, communication module 138 may transmit the processed (and/or partially processed measurements) to surface 134. Information may be transmitted from communication module 138 to surface 134 using any suitable unidirectional or bidirectional wired or wireless telemetry system, including, but not limited to, an electrical conductor, a fiber optic cable, acoustic telemetry, electromagnetic telemetry, pressure pulse telemetry, combinations thereof or the like. Communication module 138 may include a variety of different devices to facilitate communication to surface, including, but not limited to, a powerline transceiver, a mud pulse valve, an optical transceiver, a piezoelectric actuator, a solenoid, a toroid, or an RF transceiver, among others.

As illustrated, information handling system 140 may be disposed at surface 134. In examples, information handling system 140 may be disposed downhole. Any suitable technique may be used for transmitting signals from communication module 138 to information handling system 140. A communication link 150 (which may be wired, wireless, or combinations thereof, for example) may be provided that may transmit data from communication module 138 to information handling system 140. Without limitation, information handling system 140 may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, information handling system 140 may be a personal computer, a network storage device, or any other suitable device and may vary in size, shape, performance, functionality, and price. Information handling system 140 may include random access memory (RAM), one or more processing resources (e.g. a microprocessor) such as a central processing unit 142 (CPU) or hardware or software control logic, ROM, and/or other types of nonvolatile memory. Additional components of information handling system 140 may include one or more of a monitor 144, an input device 146 (e.g., keyboard, mouse, etc.) as well as computer media 148 (e.g., optical disks, magnetic disks) that may store code representative of the methods described herein. Information handling system 140 may also include one or more buses (not shown) operable to transmit communications between the various hardware components.

Figure 2:
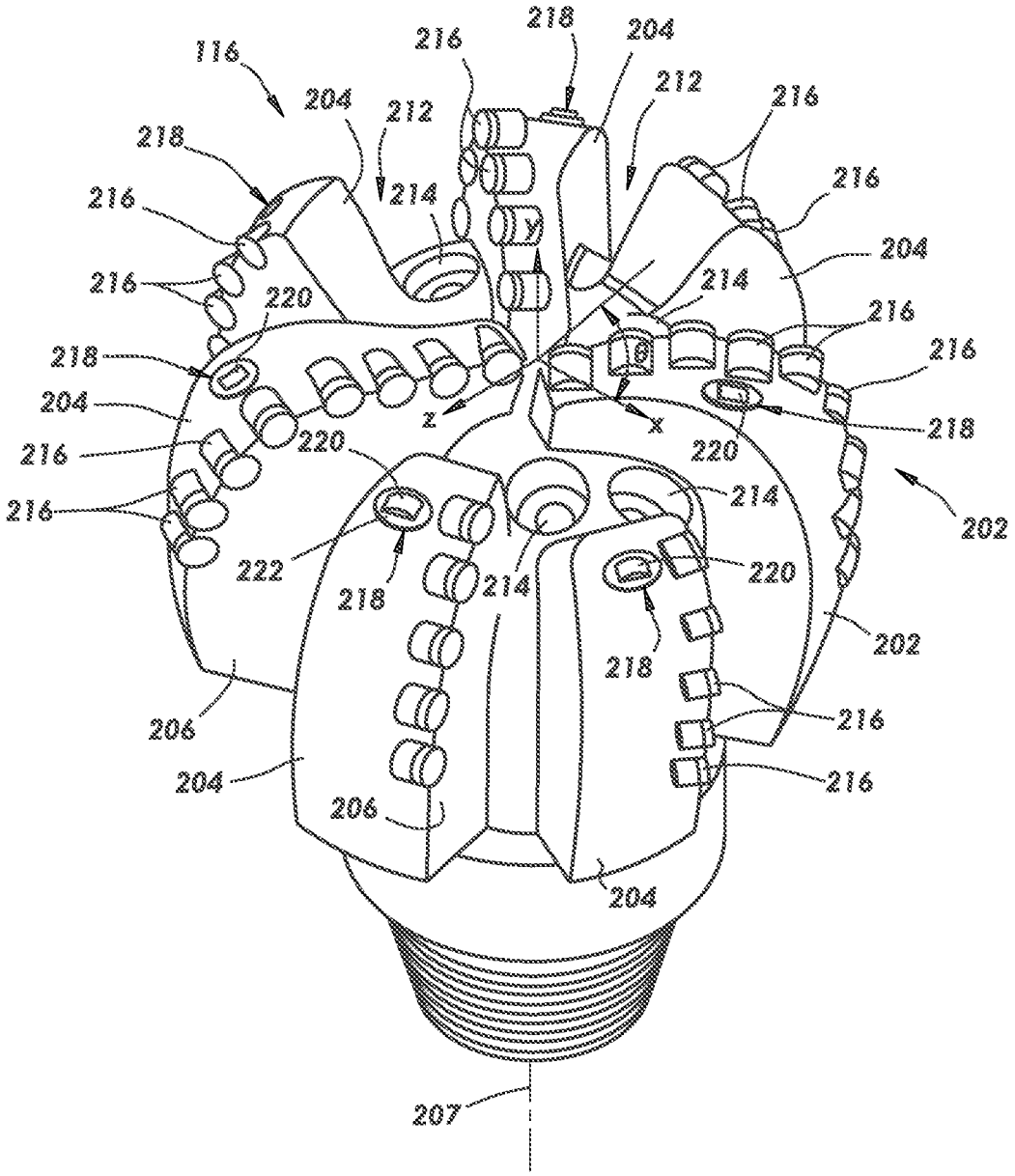
FIG. 2 is an example of a drill bit.

FIG. 2 is an example drill bit 116 that illustrates both fixed cutters 216 and rolling elements 220 on a bit body 202. Without limitation, drill bit 116 may be applied to any fixed cutter drill bit category, including polycrystalline diamond compact (PDC) drill bits, drag bits, matrix drill bits, and/or steel body drill bits. While the drill bit 116 is depicted in FIG. 2 as a fixed cutter drill bit, the principles of the present disclosure are equally applicable to other types of drill bits operable to form a wellbore including, but not limited to, fixed cutter core bits, impregnated diamond bits and roller cone drill bits.

Bit body 202 of drill bit 116 may include radially and longitudinally extending blades 204 having leading faces 206. Bit body 202 may be made of steel or a matrix of a harder material, such as tungsten carbide. Bit body 202 rotates about a longitudinal drill bit axis 207 to drill into underlying subterranean formation under an applied weight-on-bit. Corresponding junk slots 212 are defined between circumferentially adjacent blades 204, and a plurality of nozzles or ports 214 may be arranged within junk slots 212 for ejecting drilling fluid that cools drill bit 116 and otherwise flushes away cuttings and debris generated while drilling.

Bit body 202 further includes a plurality of fixed cutters 216 secured within a corresponding plurality of cutter pockets sized and shaped to receive cutters 216. Each cutter 216 in this example comprises a fixed cutter secured within its corresponding cutter pocket via brazing, threading, shrink-fitting, press-fitting, snap rings, or any combination thereof. Fixed cutters 216 are held in blades 204 and respective cutter pockets at predetermined angular orientations and radial locations to present fixed cutters 216 with a desired angle against the formation being penetrated. As drill bit 116 is rotated, fixed cutters 216 are driven through the rock by the combined forces of the weight-on-bit and the torque experienced at drill bit 116. During drilling, fixed cutters 216 may experience a variety of forces, such as drag forces, axial forces, reactive moment forces, or the like, due to the interaction with the underlying formation being drilled as drill bit 116 rotates.

Each fixed cutter 216 may include a generally cylindrical substrate made of an extremely hard material, such as tungsten carbide, and a cutting face secured to the substrate. The cutting face may include one or more layers of an ultra-hard material, such as polycrystalline diamond, polycrystalline cubic boron nitride, impregnated diamond, etc, which generally forms a cutting edge and the working surface for each fixed cutter 216. The working surface is typically flat or planar, but may also exhibit a curved exposed surface that meets the side surface at a cutting edge.

Generally, each fixed cutter 216 may be manufactured using tungsten carbide as the substrate. While a cylindrical tungsten carbide "blank" may be used as the substrate, which is sufficiently long to act as a mounting stud for the cutting face, the substrate may equally comprise an intermediate layer bonded at another interface to another metallic mounting stud. To form the cutting face, the substrate may be placed adjacent a layer of ultra-hard material particles, such as diamond or cubic boron nitride particles, and the combination is subjected to high temperature at a pressure where the ultra-hard material particles are thermodynamically stable. This results in recrystallization and formation of a polycrystalline ultra-hard material layer, such as a polycrystalline diamond or polycrystalline cubic boron nitride layer, directly onto the upper surface of the substrate. When using polycrystalline diamond as the ultra-hard material, fixed cutter 216 may be referred to as a polycrystalline diamond compact cutter or a "PDC cutter," and drill bits made using such PDC fixed cutters 216 are generally known as PDC bits.

As illustrated, drill bit 116 may further include a plurality of rolling element assemblies 218, each including a rolling element 220 disposed in housing 222. The housing 222 may be received in a housing pocket sized and shaped to receive housing 222. Without limitation, rolling element 220 may include a generally cylindrical body strategically positioned in a predetermined position and orientation on bit body 202 so that rolling element 220 is able to engage the formation during drilling. It should be noted that rolling element 220 may also be a ball bearing, cylindrical, needle, tapered, and/or circular in shape. The orientation of a rotational axis of each rolling element 221) with respect to a tangent to art outer surface of blade 204 may dictate whether any identified rolling element 220 operates purely as a rolling DOCC element, purely a rolling cutting element, or a hybrid of both. The terms "rolling element" and "rolling DOCC element" are used herein to describe a rolling element 220 in any orientation, whether it acts purely as a DOCC element, a purely as cutting element or as a hybrid of both. Rolling elements 220 may prove advantageous in allowing for additional weight-on-bit (WOB) to enhance directional drilling applications without over engagement of fixed cutters 216, and to minimize the amount of torque required for drilling. Effective DOCC also limits fluctuations in torque and minimizes stick-slip, which may cause damage to fixed cutters 216. An optimized three-dimensional position and three-dimensional orientation of rolling element 220 may be selected to extend the life of the rolling element assemblies, and thereby improve the efficiency of drill bit 116 over its operational life. As described herein, the three-dimensional position and orientation may be expressed in terms of a Cartesian coordinate system with the Y-axis positioned along longitudinal axis 207, and a polar coordinate system with a polar axis positioned along longitudinal axis 207.

Figure 3:
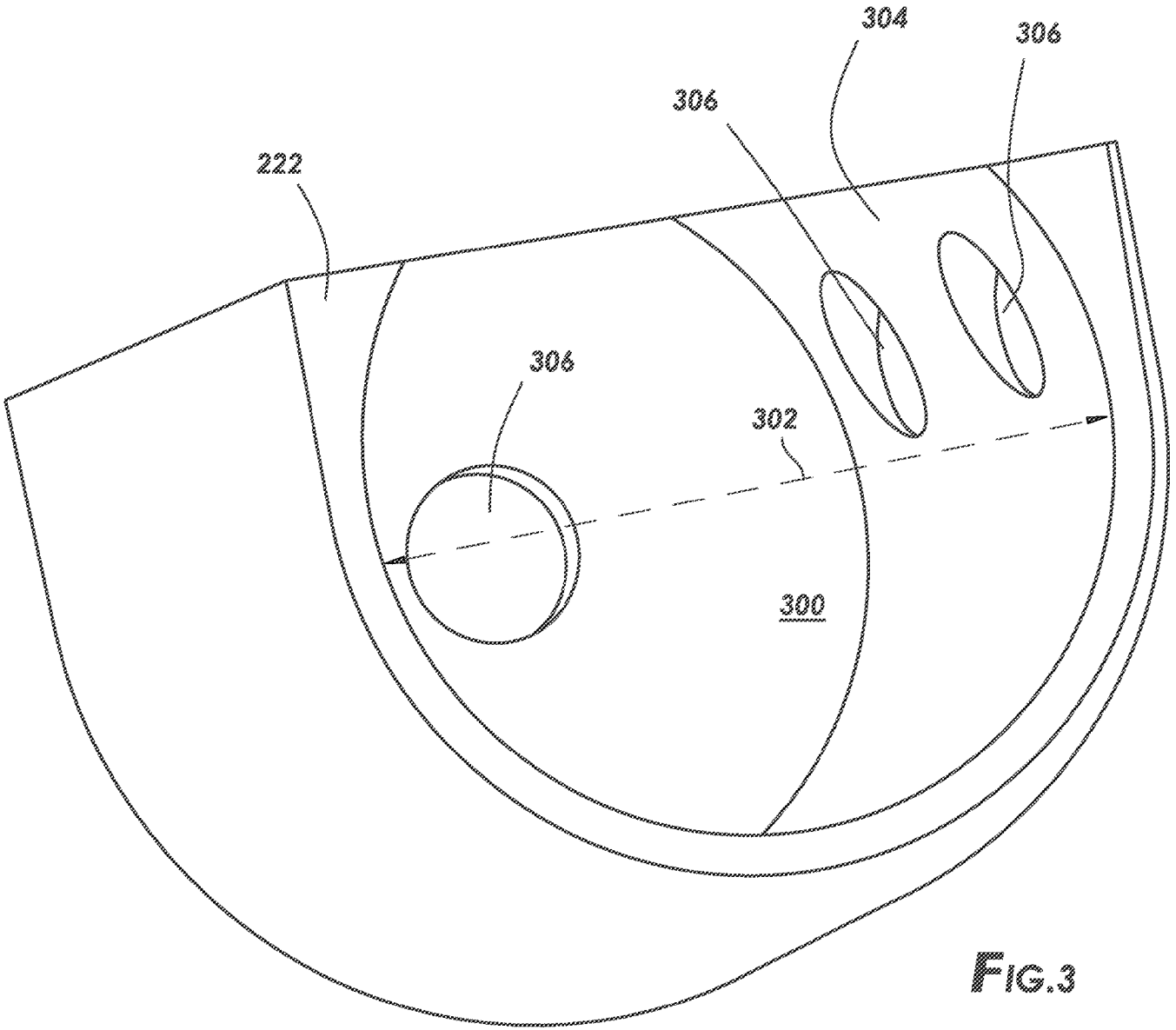
FIG. 3 is an example of a housing that may house a rolling element.

FIG. 3 illustrates housing 222 in which rolling element 220 (e.g., referring to FIG. 2) may be disposed. During drilling operations, housing 222 may need to be tough enough to withstand impact loads from a formation and hard enough to resist wear. Housing 222 may be any suitable shape, such as, cylindrical, circular, oval, square, and/or any combination thereof. Additionally, as illustrated in FIG. 2, housing 222 may include a chamber 300 that may operate and function to receive a rolling element 220. Chamber 300 may be any suitable shape to receiver a rolling element 220. The shape of chamber 300 may be circular, cylindrical, and/or any combination thereof. Chamber 300 may include an inner diameter 302 and an inner surface 304, which may define the void of material. Inner surface 304, which may in part form the inner diameter 302, may form a structural base for applying carbide powder. Without limitation, carbide powder may be boron carbide, silicon carbide, tungsten carbide, cobalt carbide, nickel carbide, calcium carbide, aluminum carbide, titanium carbide, and/or other compounds of a metal or metalloid carbon. Additionally, carbide powder may be any mixture or carbide powders. Carbide powder may form a surface upon which rolling element 220 may rest. Additionally, carbide powder may act as a surface upon which rolling element 220 may rotate upon. In examples, carbide powder may provide a surface that has a reduced friction coefficient and structural strength. The reduce friction coefficient may allow rolling element 220 to rotate easily and the structural strength of the carbide powder may increase the life of housing 222 and in turn rolling element 220.

Currently, carbide powder may be applied to inner surface 304 of housing 222. During manufacturing operations, carbide powder may be deposited onto any surface of housing 222 by a diode laser, similar to a cladding process, in which the carbide filler metal may be at least in part melted and metallurgically welded onto a base metal. It should be noted that the carbide grains maintain their intrinsic properties during the manufacturing operation. In examples, carbide powder may be applied to one or more dimples 306 disposed along inner surface 304 of housing 222. However, the laser head can be too large to access the inside of enclosed housing 222. Applying carbide powder directly to inner surface 304 (as on the nail-lock retainer currently used to retain rolling element 220) may involve hand grinding of a very hard material, which adds cost and time, and may result in inconsistency along inner surface 304.

Figure 4:
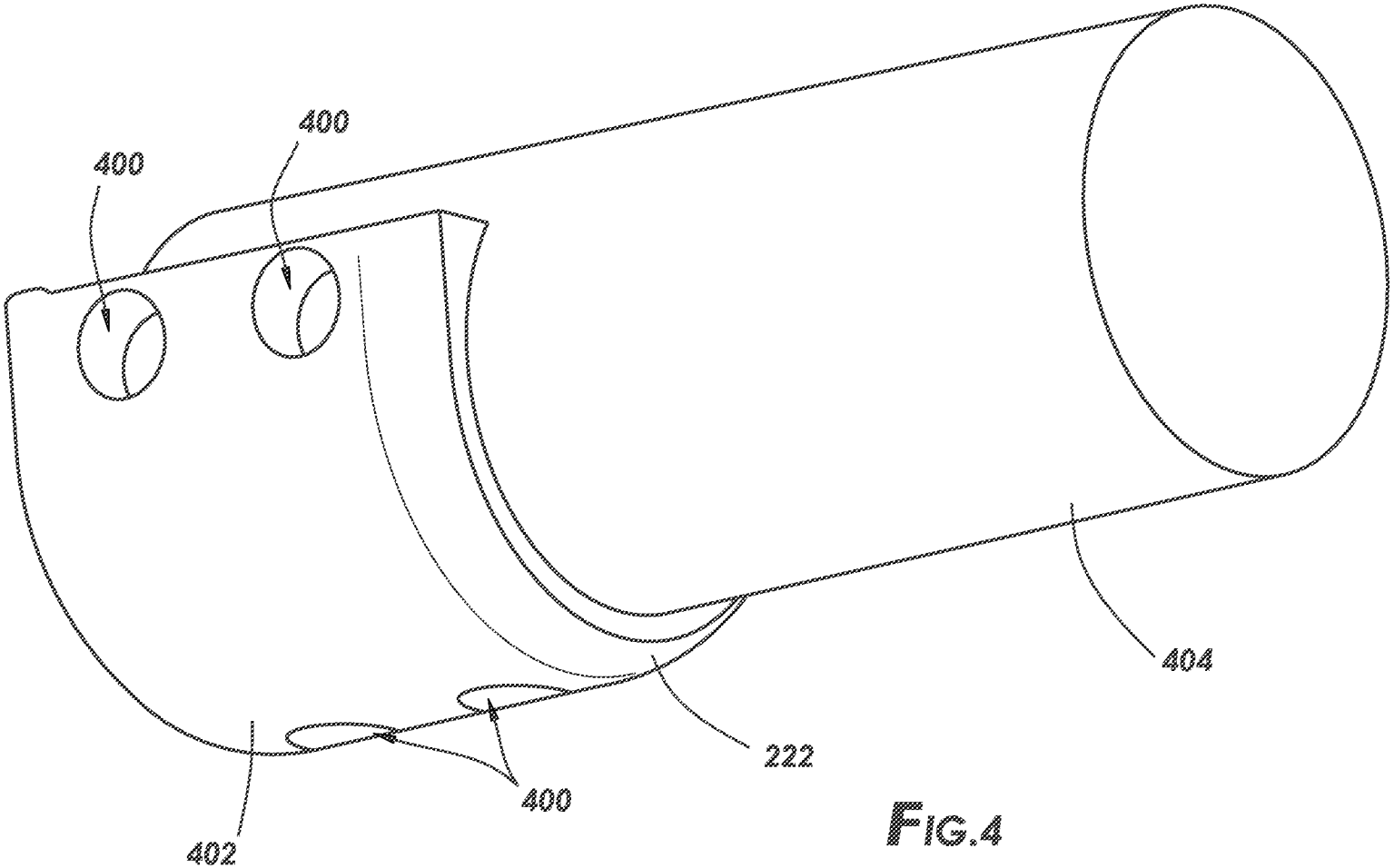
FIG. 4 is an example of a plug positioned in the housing during a manufacture process.

FIG. 4 illustrates an example housing 222 and plug 404 used for applying the carbide powder from the outside of housing 222 through access ports 400 in housing 222. It should be noted that there may be any number of access ports 400 placed at any suitable location along housing 222. Access ports 400 traverse from outer surface 402 of housing 222 to inner surface 304 (e.g., referring to FIG. 2) of housing 222.

As illustrated in FIG. 4, a plug 404 may be disposed in housing 222 before application of the carbide powder. Plug 404 may be any suitable shape, for example, cylindrical, circular, elliptical, and/or any combination thereof. The shape of plug 404 may mirror the shape of inner surface 304 (e.g., referring to FIG. 3) of housing 222. Without limitation, plug 404 may be made of any suitable material, for example, graphite, ceramic, diamond, or a plug with a coating such as Teflon, and/or the like. It should be noted that any material may be utilized that may have properties that prevent the material from melting at hardmetal application temperature and molten hard metal does not wet the surface of plug 404. Additionally, plug 404 may include an outer diameter that may be nearly identical to inner diameter 302 (e.g., referring to FIG. 3) of housing 222. For example, the outer diameter of plug 404 may be between about 0.0005 to about 0.0015 inches (about 0.0127 to-about 0.0381 mm) smaller in diameter than the inner diameter of housing 222. Any internal features like chamfers or radii would be matched on plug 404 within +0.001 inches (+0.0254 mm) of the maximum feature callout specified. A very tight fit is desired to control the flow of carbide powder material on the inner surface of housing 222. The outer diameter of plug 404 may allow plug 404 to tightly fit to housing 222, as illustrated in FIG. 4. Additionally, plug 404 may be modified to be slightly recessed an additional about 0.001 to about 0.002 inches (about 0.0254 to about 0.0508 mm) off the inner diameter of housing 222 so that the carbide material may protrude off and/or over the inner surface 304 (e.g., referring to FIG. 3) of housing 222. This may allow the rolling element 220 (e.g., referring to FIG. 2) to contact the carbide material rather than inner surface 304 of housing 222 and reduces the overall wear on housing 222.

With continued reference to FIG. 4, during depositing operations access ports 400 may allow for carbide powder to be deposited on inner surface 304 (e.g., referring to FIG. 3) and then back filled to outer surface 402. For example, plug 404 is placed in chamber 300 (e.g., referring to FIG. 3) with a tight fit between the outer surface of plug 404 and inner surface 304 of chamber 300, as descried above. Plug 404 may act as a foundation upon which carbide powder may rest during carbide powder depositing operations. During depositing operations, carbide powder may be sent through access ports 400 by any suitable laser cladding machine. In examples, a nozzle of the laser cladding machine may include both a laser for cladding and ports for depositing carbide powder. During depositing operations, the laser cladding machine may send the carbide powder from the nozzle of the laser cladding machine through an access port 400, depositing the carbide powder directly to plug 404. A laser may then clad the carbide powder to inner surface 304. Plug 404 may provide a smooth surface for the carbide powder to be deposited. In examples, the carbide powder does not adhere to plug 404 but moves around plug 404 in the space between inner surface 304 and plug 404. As carbide powder is added by the laser cladding machine to and around plug 404, the carbide powder fills access ports 400 from plug 404 and inner surface 304 to outer surface 402. Each access port 400 is filled with carbide powder to finish the depositing operation. After depositing operations plug 404 is removed, which may provide a smooth finish of carbide powder within chamber 300. Thus, no inner diameter finishing may be needed, and minimal finishing may be required for less critical outer diameter may be performed.

Figure 5:
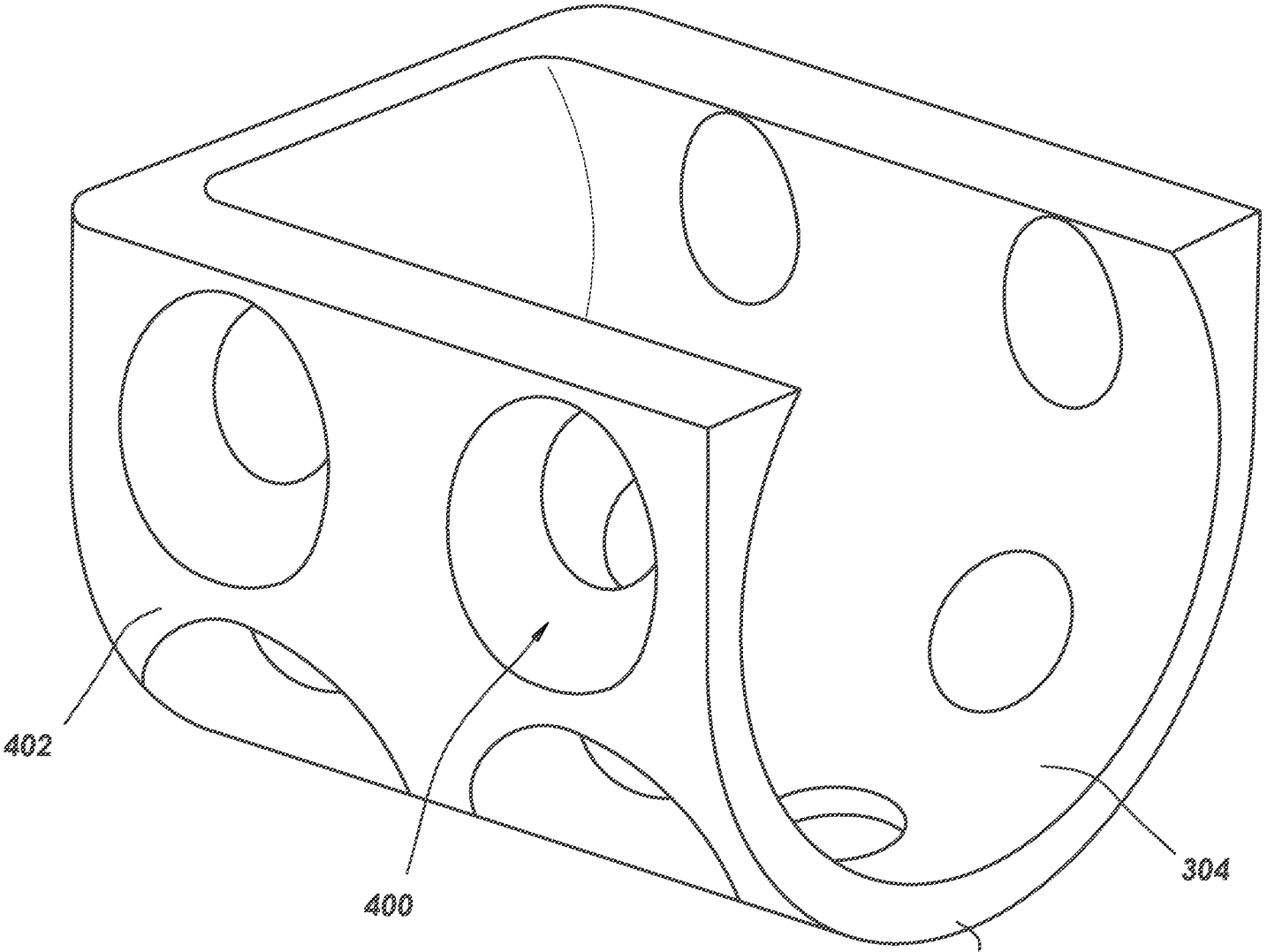
FIGS. 5-7 illustrate different examples of access ports positioned in the housing.
Figure 6:
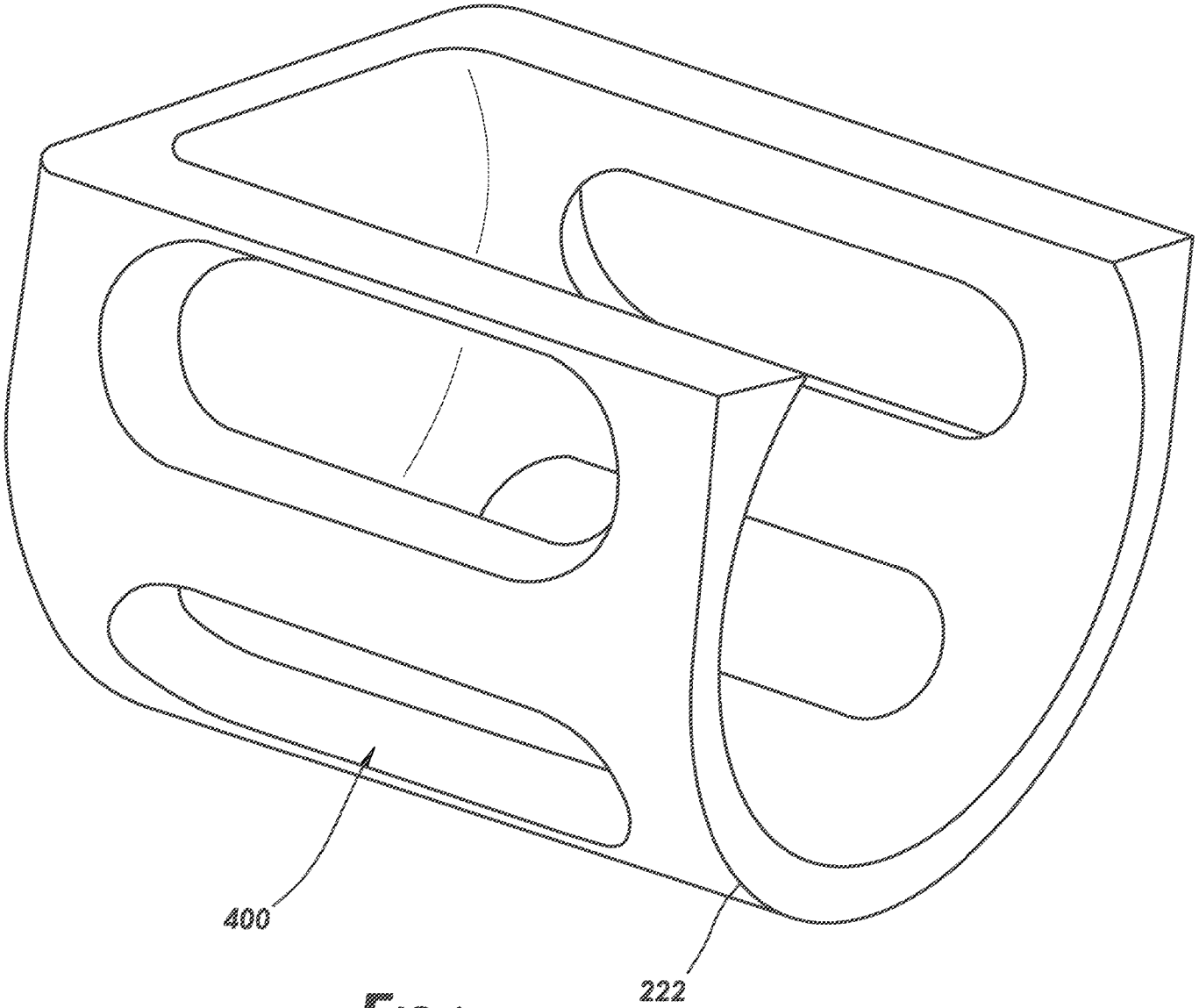
Figure 7:
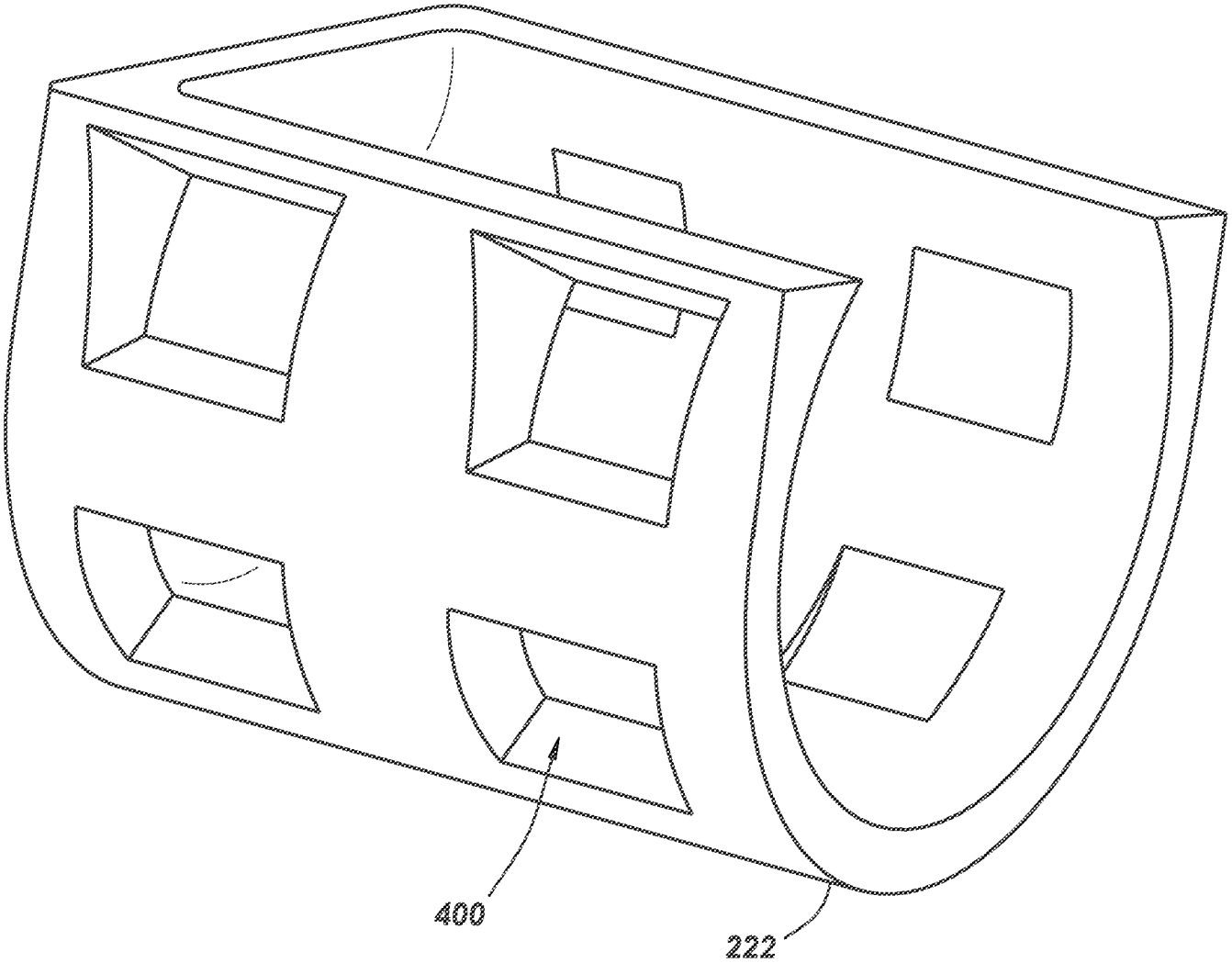

FIGS. 5-7 illustrate example housing 222 with different access ports 400. Different shapes for access ports 400 may provide for different shapes and deposition of the carbide powder. As illustrated in FIG. 5, access ports 400 may have a smaller diameter at inner surface 304 than outer surface 402. *Ibis* may provide a more even fill of carbide material in access ports 400 and increase adhesion of the carbide powder to surface of housing 222 within, near, and/or around access ports 400. An even fill may seal any surfaces of housing 222. Any imperfections in surfaces of housing 222 may introduce leak paths for deposits to move into housing 222 which may lock the rolling element 220 (e.g., referring to FIG. 2) when housing 222 is attached to drill bit 116 (e.g., referring to FIG. 2). As illustrated in FIG. 6, access ports 400 may be elongated and oval in shape. This may provide an increased carbide surface to absorb wear and abrasion from rolling element 220. An increase in carbide surface area on inner surface 304 may reduce the amount of wear on housing 222 and prevent damage to and/or destruction of one or more rolling elements 220 on drill bit 116. FIG. 7 further illustrates access ports 400 that may be square in shape. As discussed above, there may be any number of access ports 400 positioned at any suitable location of housing 222. Spacing of access ports 400 may be determined by creating the highest amount of carbide surface area on inner surface 304 (e.g., referring to FIG. 3) of housing 222 and further prevent the deformation of a based metal of housing 222 when the carbide powder is cladded to housing 222. Additionally, access ports 400 that are closely arranged may prove problematic for the deposition of carbide powder during the cladding process. For example, heat from the first deposit to a first access port may distort one or more access ports 400 that may be adjacent to the first access port. Deformation of one or more access ports 400 may prevent uniform distribution of molten material across access port 400. It should be noted that, positioning of carbide powder may provide wear resistance to the upper portion of housing 222 which retains rolling element 220, and thus increase retention of rolling element 220.

Statement 1. A method comprise placing a plug in a chamber of a housing, wherein the housing includes an outer surface, an inner surface that defines the chamber, and one or more access ports that traverse through the housing from the inner surface to the outer surface; sending a carbide powder through the one or more access ports such that the carbide power is directed around the plug and deposited on the inner surface; and removing the plug from the chamber.

Statement 2. The method of statement 1, further comprising filling the one or more access ports with the carbide powder from the inner surface of the housing to the outer surface of the housing.

Statement 3. The method of statements 1 or 2, wherein the plug has an outer diameter between about 0.0005 inches to about 0.0015 inches smaller than an inner diameter of the housing.

Statement 4. The method of statement 3, wherein the plug is graphite or ceramic.

Statement 5. The method of statements 1-3, further comprising placing a rolling element in the chamber.

Statement 6. The method of statement 5, further comprising attaching the housing to a drill bit having a plurality of radially and longitudinally extending blades, wherein the attaching comprising placing the housing into an opening in one of the blades wherein a portion of the rolling element extends from the housing.

Statement 7. The method of statements 1-3 or 5, wherein the one or more access ports are circular.

Statement 8. The method of statements 1-3 or 5, wherein the one or more access ports are square.

Statement 9. The method of statements 1-3 or 5, wherein the one or more access ports are elongated.

Statement 10. The method of statements 1-3 or 5, wherein the one or more access ports are oval.

Statement 11. The method of statements 1-3 or 5, wherein the one or more access ports has a smaller diameter at the inner surface than at the outer surface.

Statement 12. A rolling element assembly may comprise a housing having an outer surface and inner surface, wherein the inner surface defines a chamber; one or more access ports, wherein the one or more access ports traverse through the housing from the inner surface to the outer surface; carbide powder on the inner surface; and a rolling element attached in the chamber with a portion of the rolling element extends from the chamber, wherein the rolling element is in contact with the carbide powder deposited on the inner surface.

Statement 13. The rolling element assembly of statement 12, wherein the one or more access ports are circular.

Statement 14. The rolling element assembly of statement 12, wherein the one or more access ports are square.

Statement 15. The rolling element assembly of statement 12, wherein the one or more access ports are elongated.

Statement 16. The rolling element assembly of statement 12, wherein the one or more access ports are oval.

Statement 17. The rolling element assembly of statements 12-16, wherein the one or more access ports is smaller at the inner surface than the outer surface.

Statement 18. A drill bit may comprise a bit body; a blade attached to the bit body; a fixed cutter attached in a cutter pocket formed in the blade with a portion of the fixed cutter extending from the blade; a housing attached in a housing pocket formed in the blade, wherein the housing includes a chamber, an outer surface, an inner surface defining the chamber, and one or more access ports that traverse through the housing from the outer surface to the inner surface; carbide powder deposited on the inner surface; a rolling element attached in the chamber and in contact with the carbide powder with a portion of the rolling element extending from the blade.

Statement 19. The drill bit of statement 18, wherein a plurality of housings are attached to one or more blades attached to the bit body.

Statement 20. The drill bit of statements 18 or 19, wherein the one or more access ports are circular, square, elongated, or oval.

It should be understood that, although individual examples may be discussed herein, the present disclosure covers all combinations of the disclosed examples, including, without limitation, the different component combinations, method step combinations, and properties of the system.

It should be understood that the compositions and methods are described in terms of "comprising," "containing," or "including" various components or steps, the compositions and methods may also "consist essentially of" or "consist of" the various components and steps. Moreover, the indefinite articles "a" or "an," as used in the claims, are defined herein to mean one or more than one of the element that it introduces.

All numerical values within the detailed description and the claims herein modified by "about" or "approximately" with respect the indicated value are intended to take into account experimental error and variations that would be expected by a person having ordinary skill in the art.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only, and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A method comprising:

placing a plug in a chamber of a housing, wherein the housing includes an outer surface, an inner surface that defines the chamber, and one or more access ports that traverse through the housing from the inner surface to the outer surface;

sending a carbide powder through the one or more access ports such that the carbide powder is directed around the plug and deposited on the inner surface;

filling the one or more access ports with the carbide powder from the inner surface of the housing to the outer surface of the housing; and removing the plug from the chamber.

2. The method of claim 1, wherein the plug has an outer diameter between about 0.0005 inches to about 0.0015 inches smaller than an inner diameter of the housing.

3. The method of claim 2, wherein the plug is graphite or ceramic.

4. The method of claim 1, wherein the one or more access ports are circular.

5. The method of claim 1, wherein the one or more access ports are square.

6. The method of claim 1, wherein the one or more access ports are elongated.

7. The method of claim 1, wherein the one or more access ports are oval.

8. The method of claim 1, wherein the one or more access ports has a smaller diameter at the inner surface than at the outer surface.

9. The method of claim 1, further comprising:

placing a rolling element in the chamber.

10. A method, comprising:

placing a plug in a chamber of a housing, wherein the housing includes an outer surface, an inner surface that defines the chamber, and one or more access ports that traverse through the housing from the inner surface to the outer surface;

sending a carbide powder through the one or more access ports such that the carbide power is directed around the plug and deposited on the inner surface;

removing the plug from the chamber; and placing a rolling element in the chamber.

11. The method of claim 10, further comprising attaching the housing to a drill bit having a plurality of radially and longitudinally extending blades, wherein the attaching comprising placing the housing into an opening in one of the blades wherein a portion of the rolling element extends from the housing.

12. The method of claim 10, wherein the plug has an outer diameter between about 0.0005 inches to about 0.0015 inches smaller than an inner diameter of the housing.

13. The method of claim 12, wherein the plug is graphite or ceramic.

14. The method of claim 10, wherein the one or more access ports are circular.

15. The method of claim 10, wherein the one or more access ports are square.

16. The method of claim 10, wherein the one or more access ports are elongated.

17. The method of claim 10, wherein the one or more access ports are oval.

18. The method of claim 10, wherein the one or more access ports has a smaller diameter at the inner surface than at the outer surface.

* * * * *